US005681195A

United States Patent [19]

Egami et al.

[11] Patent Number: 5,681,195

[45] Date of Patent: Oct. 28, 1997

[54] FLAT DISPLAY DEVICE AND MANUFACTURING METHOD THEREOF

[75] Inventors: Norihiko Egami; Masaru Nagaike; Takashi Ichiyanagi, all of Hirakata; Hideo Suzuki, Neyagawa, all of Japan

[73] Assignee: Matsushita Electric Industrial Co., Ltd., Osaka, Japan

[21] Appl. No.: 314,761

[22] Filed: Sep. 29, 1994

[30] Foreign Application Priority Data

| | | | |
|---|---|---|---|
| Sep. 30, 1993 | [JP] | Japan | 5-244464 |
| May 23, 1994 | [JP] | Japan | 6-108418 |
| Jun. 16, 1994 | [JP] | Japan | 6-133999 |

[51] Int. Cl.[6] ..... H01J 9/02

[52] U.S. Cl. ..... 445/24; 445/29

[58] Field of Search ..... 445/24, 29

[56] References Cited

U.S. PATENT DOCUMENTS 4,950,193 8/1990 Jang ..... 445/24

FOREIGN PATENT DOCUMENTS 4-160741 6/1992 Japan .
4-174948 6/1992 Japan .
4-249029 9/1992 Japan .

*Primary Examiner*—Kenneth J. Ramsey
*Attorney, Agent, or Firm*—Wenderoth, Lind & Ponack

[57] ABSTRACT

A flat display device includes cathodes, a screen plate having a fluorescent screen, a plate-like electrode for controlling electron beams from the cathodes to the fluorescent screen, and a frame body for supporting the plate-like electrode. The frame body securely fixes both ends of the plate-like electrode at two opposite sides thereof, and has an elastic body for supporting the plate-like electrode in a stretched state by a spring force of the elastic body. The flat display device is made by the steps of pressing a pair of leaf springs provided respectively at two confronting sides of a frame body to thereby bend the frame body in such directions that the confronting sides become close to each other, securely fixing both ends of a plate-like electrode to the pair of bent leaf springs, and releasing the pressing of the leaf springs to thereby restore the leaf springs.

7 Claims, 15 Drawing Sheets

FLAT DISPLAY DEVICE AND MANUFACTURING METHOD THEREOF

BACKGROUND OF THE INVENTION

The present invention relates to a flat display device used as an image receiving tube in a TV receiver or a terminal display of a computer or the like, and a manufacturing method thereof.

Recently attention is being focused on a flat display device wherein a fluorescent screen of an image receiving tube is divided into many small sections, and electron beams are scanned for every divided small section to thereby form an image as a whole. Such a flat display device as above is disclosed in Japanese Laid-Open Patent Publication Nos. 4-160741 (160741/1992), 4-174948 (174948/1992), and 4-249029 (249029/1992), etc.

Referring to FIG. 44 showing the configuration of a display device of the above type, there is arranged an electrode supporting plate 3 held between a back container 1 of a flat glass plate and a multilayer plate-like electrode 2.

The electrode supporting plate 3 positioned on a fixed stage 4 of the back container 1 supports a plurality of linear cathodes 5 in a manner so as to insulate the cathodes 5 from each other. Likewise, screws 6 insulate and support the multilayer electrodes 2 and the electrode supporting plate 3 on the fixed stage 4. A front glass container 8 covers a screen plate 7 having a fluorescent screen and is sealed air-tight at its opening end to the peripheral edge of the back container 1 via a frit glass layer 9. Although not shown in FIG. 44, in order to fulfill the function of the plate-like electrodes 2 to condense and deflect thermions radiated from the cathodes 5 to many electron beams, many holes are opened in each plate-like electrode 2 to pass electron beams therethrough. A back electrode is provided at the rear side of the cathodes 5 so as to direct the thermions from the cathodes 5 towards the screen plate 7.

The plate-like electrodes 2 are formed of 36%-nickel-invar alloy of C: 0.008%, Si: 0.10%, Mn: 0.90%, P: 0.007%, S: 0.011%, and Ni: 36%, for example, a product known as the trademark of "INVAR" and laminated one another via glass insulating layers. As is shown in FIGS. 45 and 46, the insulating layer is constituted of a glass rod 10 and glass rods 11 at both sides of the glass rod 10. The glass rod 11 has a lower melting point than the glass rod 10 for the purpose of bonding. After units of three glass rods 10 and 11 are scattered between each pair of layers of plate-like electrodes 2, the units are heated, so that only the glass rods 11 are melted. Accordingly, the plurality of plate-like electrodes 2 are insulated and supported together while keeping a predetermined distance determined by the diameter of the glass rod 10.

Although the layered plate-like electrodes 2 are bulky in size in the above-described display device, high flatness is required, because it is hard to obtain images of good quality if the electrodes 2 warp over ±10 μm. Nevertheless, in spite of the necessity to insulate and support the plate-like electrodes 2 with high flatness via a predetermined distance, the thickness of the insulating layers between the electrodes 2 is prone to be irregular in the conventional arrangement as described hereinabove. The flatness and the interval of the electrodes 2 become non-uniform. Moreover, it takes trouble to scatter many glass rods 10, 11 between layers of the electrodes 2, bringing about an increase of manufacturing costs. In addition, the glass rods 10, 11 are easy to crack as a result of vibrations or the like, thus generating dust.

SUMMARY OF THE INVENTION

An object of the present invention is therefore to provide a flat display device and a manufacturing method thereof whereby a plurality of plate-like electrodes are held and insulated efficiently with high flatness.

In accomplishing these and other objects, according to a first aspect of the present invention, there is provided a flat display device that comprises cathodes, a screen plate having a fluorescent screen, a plate-like electrode for controlling electron beams from the cathodes to the fluorescent screen, and a frame body for supporting the plate-like electrode. The frame body securely fixes both ends of the plate-like electrode at two opposite sides thereof, and has an elastic body for supporting the plate-like electrode in a stretched state by a spring force of the elastic body.

According to a second aspect of the present invention, there is provided a manufacturing method of a flat display device, which comprises the steps of pressing a pair of leaf springs provided respectively at two confronting sides of a frame body to thereby bend the frame body in such directions that the confronting sides become close to each other, securely fixing both ends of a plate-like electrode to the pair of bent leaf springs, and releasing the pressing of the leaf springs to thereby restore the leaf springs.

According to a third aspect of the present invention, there is provided a manufacturing method of a flat display device, which comprises the steps of pressing two confronting sides of an elastic frame body inward to thereby bend the frame body and reduce the interval between the confronting two sides, securely fixing both ends of a plate-like electrode to the two confronting sides of the reduced interval, and releasing the pressing to thereby restore the two confronting sides of the frame body.

According to a fourth aspect of the present invention, there is provided a manufacturing method of a flat display device which comprises the steps of pressing two confronting sides of an elastic frame body inward to thereby bend the frame body and reduce interval between the confronting two sides thereof, layering and securely fixing both ends of a plate-like electrode to the two confronting sides of the frame body with the reduced distance via a ceramic layer, and releasing the pressing to thereby restore the two confronting sides of the frame body.

According to a fifth aspect of the present invention, there is provided a supporting method of a plate-like electrode of a flat display device which comprises the steps of pulling both ends of a plate-like electrode in two opposite directions parallel to its plate surface, thereby generating a tensile force of uniform distribution to the plate surface, pressing and bending two confronting sides of an elastic frame body inward with a force distributed so as to approximately balance with the tensile force in each direction, securely fixing both ends of the plate-like electrode where the tensile force is exerted on the two confronting sides of the bent frame body, and releasing the tensile force and the pressing force.

According to a sixth aspect of the present invention, there is provided a supporting method of a plate-like electrode of a flat display device which comprises the steps of pressing two confronting sides of an elastic frame body inward to thereby bend the frame body, securely fixing both ends of the plate-like electrode to the two confronting sides of the bent frame body; and releasing the pressing. The pressing is conducted with a pressing force distributed so that it deforms the frame body so as to add a uniform tension to the plate-like electrode when the pressing is released.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
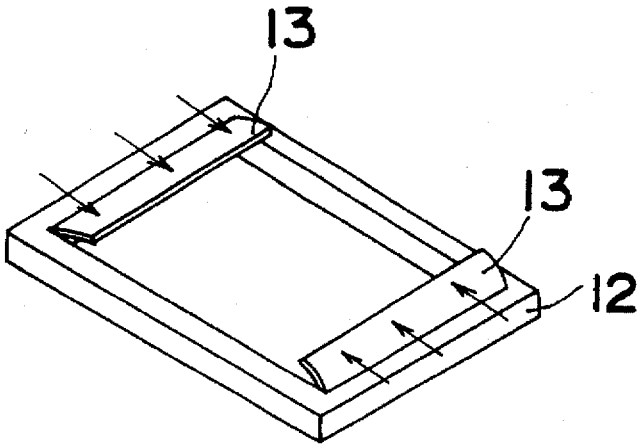
FIGS. 1, 3, and 5 are perspective views when a plate-like electrode and a frame body are combined in a first embodiment of the present invention.

Before the description of the present invention proceeds, it is to be noted that like parts are designated by like reference numerals throughout the accompanying drawings.

Preferred embodiments of the present invention will be discussed with reference to the accompanying drawings.

Figure 2:
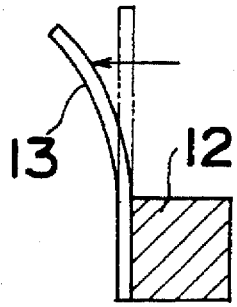
FIGS. 2, 4, and 6 are sectional side views of the combined parts in FIGS. 1, 3, and 5 respectively.
Figure 3:
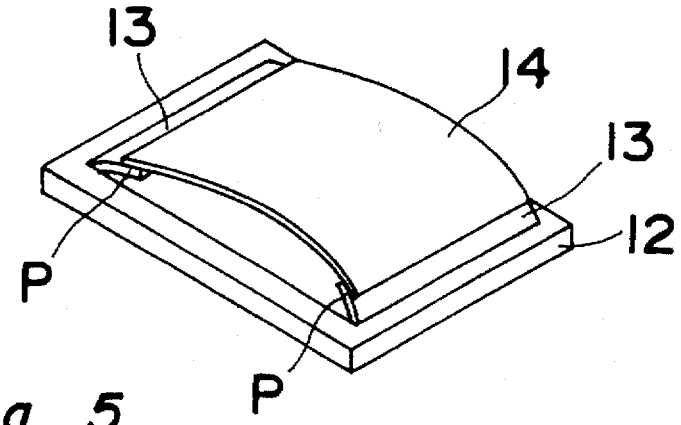
Figure 4:
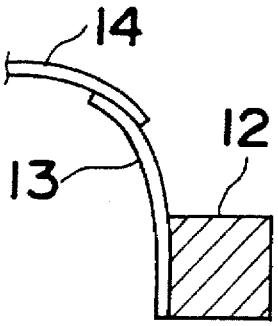

A square frame body 12 in a flat display device of a first embodiment of the invention has a pair of leaf springs 13 respectively standing erect from two confronting sides (opposite to each other), as shown in FIG. 1. The leaf springs 13 in the state of FIGS. 1 and 2 are pressed in directions of the arrows against the spring forces. Both ends of a plate-like electrode 14 which warps in the longitudinal direction is securely coupled to the leaf springs 13 bent in the directions so as to be close to each other are securely coupled by welding, soldering or a similar manner as is clearly shown in FIGS. 3 and 4.

Figure 5:
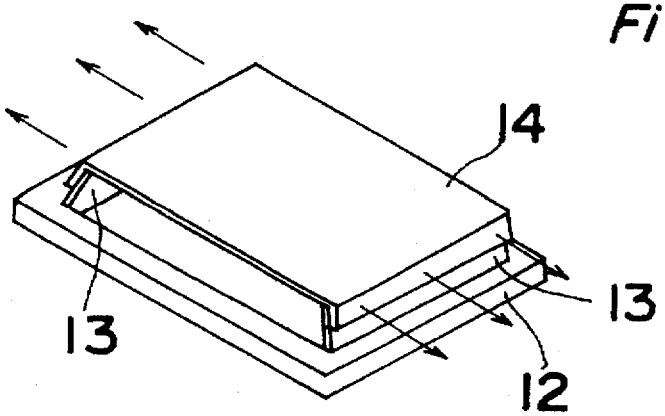
Figure 6:
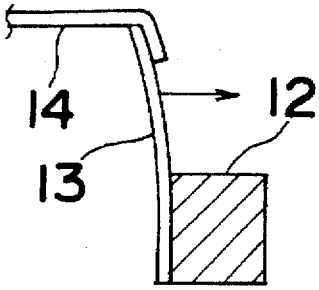

Then, when the above pressing of the leaf springs 13 is freed, the leaf springs 13 are returned by their own spring action in directions of arrows of FIGS. 5 and 6. In consequence of this, a tensile force acts on the plate-like electrode 14 in the longitudinal direction, whereby the plate-like electrode 14 is stretched between the leaf springs 13 so as to maintain a high degree of flatness. Each of the leaf springs 13 is constituted of an elastic metallic plate attached to the frame body 12.

Figure 7:
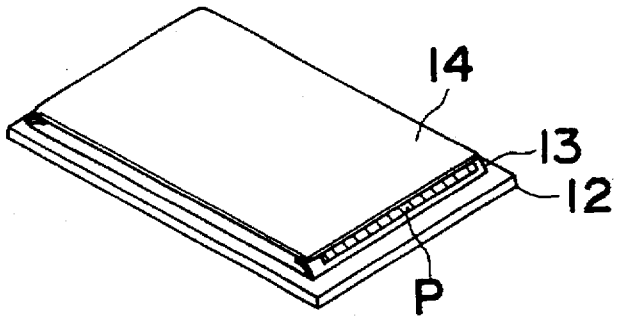
FIGS. 7, 8, and 9 are perspective views showing the combined state of a plate-like electrode and a frame body in a modified example of the first embodiment of the present invention.
Figure 8:
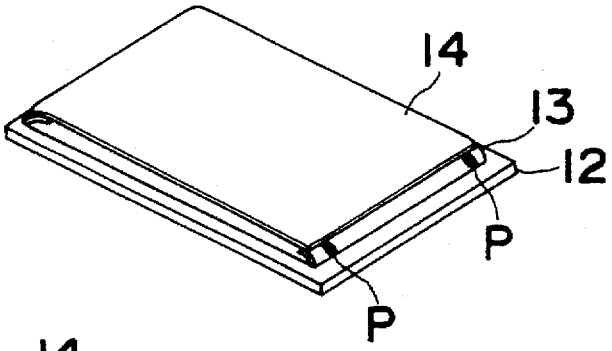
Figure 9:
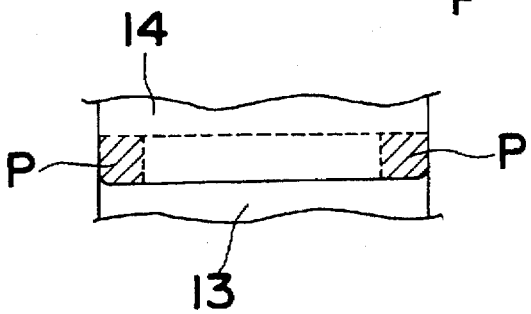

In a modified embodiment shown in FIG. 7 according to the first embodiment, the plate-like electrode 14 is fixed to the leaf springs 13 face to face at a band-shaped overlapping region P. However, the plate-like electrode 14 may be bonded to each leaf spring 13 only at two points P, namely, at two corners as exemplified in FIGS. 8 and 9, or at three or more points.

Figure 10:
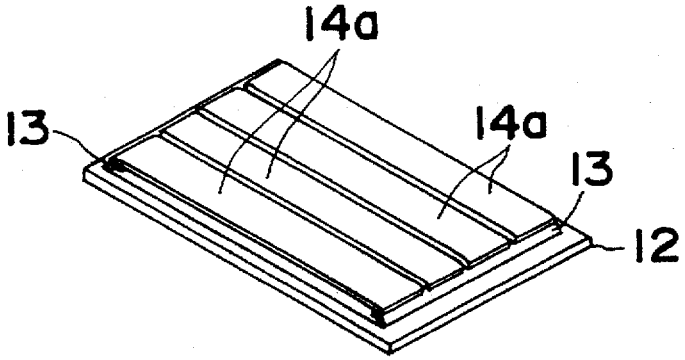
FIG. 10 is a perspective view of the combined state of a plate-like electrode and a frame body in a second embodiment of the present invention.

According to a second embodiment of the present invention of FIG. 10, a plurality of strips of plate-like electrodes **14*a* (strip electrodes), for example four strips of plate-like electrodes 14*a*, are supported parallel to each other between the pair of leaf springs 13 of the frame body 12. This embodiment is advantageous in that a high degree of flatness is ensured for the plate-like electrodes 14*a***.

Figure 11:
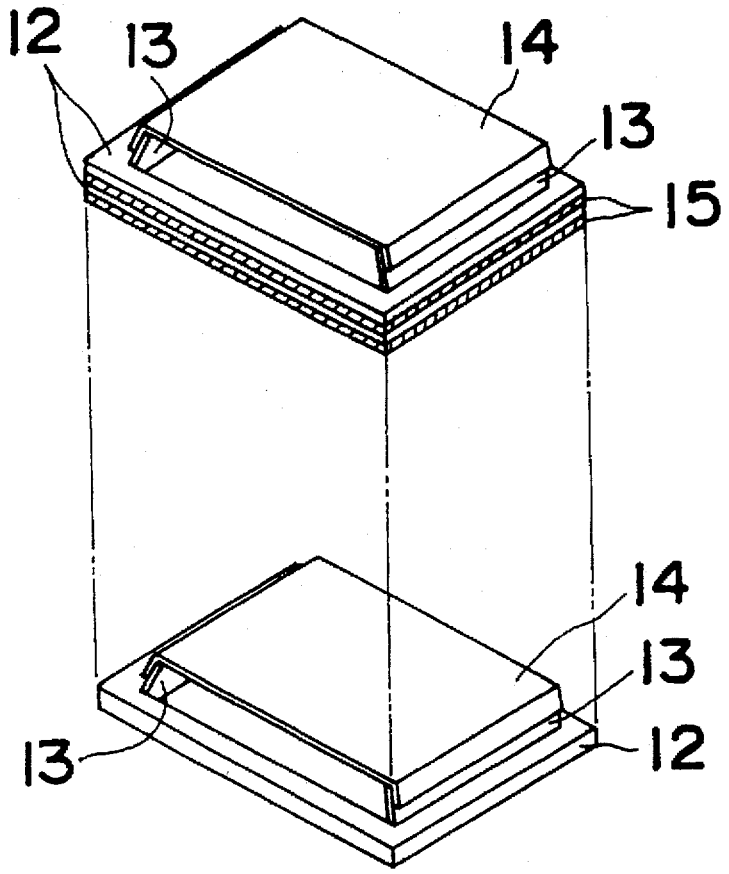
FIGS. 11 and 12 are a perspective view and a partially-sectional side view in the state where a plate-like electrode is combined with the frame body in a third embodiment of the present invention.
Figure 12:
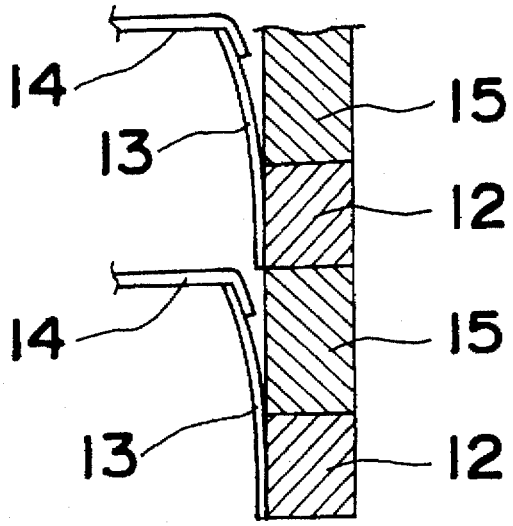

In FIGS. 11 and 12 showing a third embodiment of the present invention, when a plurality of frame bodies 12 are to be layered after the plate-like electrodes 14 or the strip electrodes **14*a* are completely stretched on the frame bodies 12, a frame-like insulating spacer 15 is interposed between the adjacent frame bodies 12 to maintain a predetermined distance of the adjacent electrodes 14 or 14*a*, and then the frame bodies 12** are soldered or welded at both ends thereof.

Figure 13:
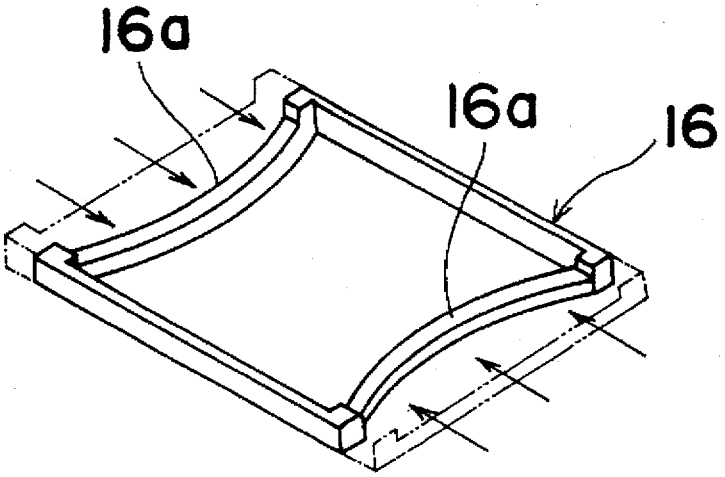
FIGS. 13, 14, and 15 are perspective views of a combining process of a plate-like electrode and a frame body in a fourth embodiment of the present invention.
Figure 14:
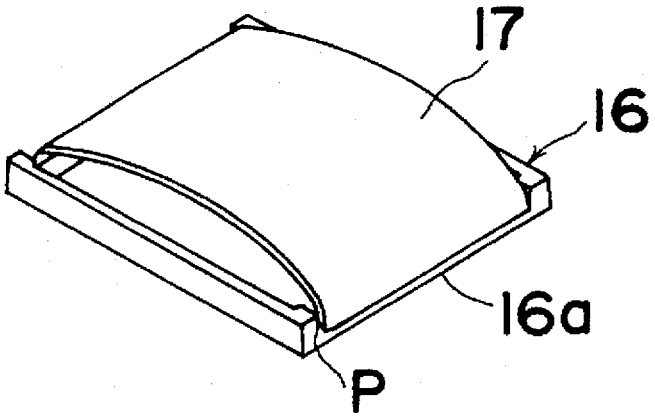
Figure 15:
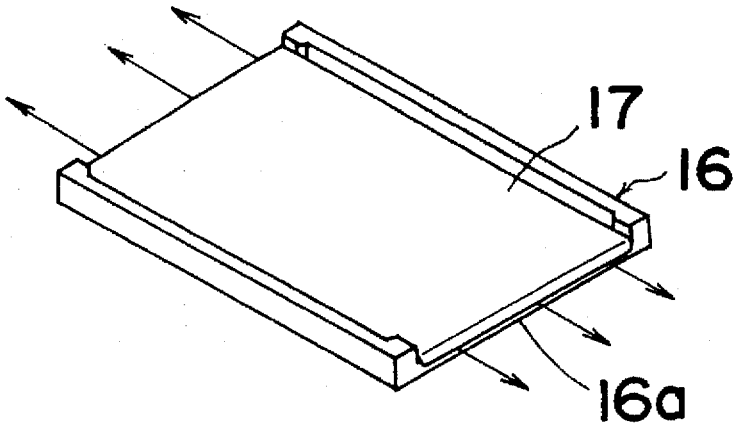

Referring now to FIGS. 13–15, a square frame body 16 made of metal in a fourth embodiment of the invention has the function of a spring by itself. In the fourth embodiment, as indicated by arrows in FIG. 13, two opposing sides of the frame body 16 are pressed inward to bend the frame body 16. Thereafter, in FIG. 14, both ends of a plate-like electrode 17 warped in the longitudinal direction are overlapped in a manner so as to cover recessed step portions **16*a* i.e. the opposite sides 16*a* of the frame body 16, and is securely bonded at points or band-like region P to the bent frame body 16 by welding or soldering. When the frame body 16 is released from being pressed, the plate-like electrode 17 is elastically stretched between the two confronting sides 16*a* of the frame body 16, which are restored to the original state, as shown in FIG. 15. At this time, the plate-like electrode 17 maintains a high degree of flatness without a warp. The fixing points or region P may be at the outer side face of the step portion 16***a* or at the upper face of the step portion 16*a*.

Since both ends of the plate-like electrode 17 are fixed while directly overlapping over the two sides 16*a* of the frame body 16 according to the above fourth embodiment of the invention, the mutual distance of the plate-like electrodes 17 when layered in a plurality of stages can be regulated with much higher accuracy. Both ends of the plate-like electrode 17 may be tightly bonded to the two sides 16*a* of the frame body 16 face to face over all of the overlapping area, i.e. the band-like region P, or may be bonded only at corners (the points P), similar to the case as described earlier. Moreover, the plate-like electrode 17 may be a plurality of strips. When a plurality of frame bodies 16 with the plate-like electrodes 17 are to be layered, an insulating layer or an insulating plate intervenes between the frame bodies 16 to thereby set the distance of the plate-like electrodes 17 at a predetermined value. The frame bodies 16 may be mutually welded or soldered at any side, that is, two longer sides or non-recessed ends of two shorter sides.

Further, the plate-like electrode 17 may not be totally formed of metal, but may be obtained by coating both faces or one face of an insulating film with a thin metallic film.

Figure 16:
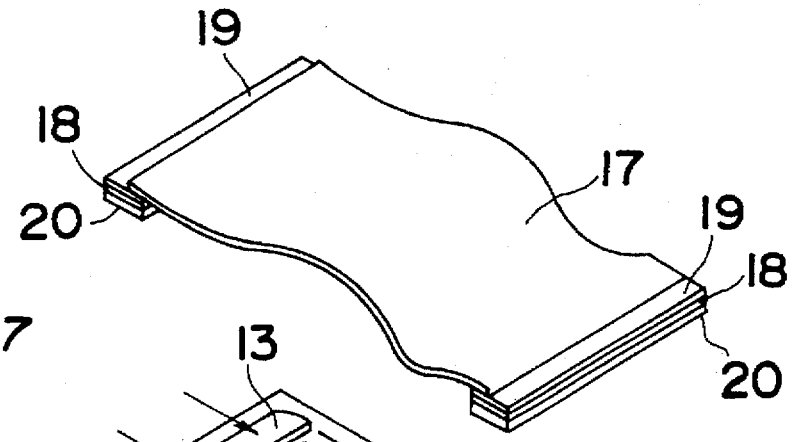
FIGS. 16, 17, 18, and 19 are perspective views of an assembling process of a plate-like electrode and a frame body in a fifth embodiment of the present invention.
Figure 17:
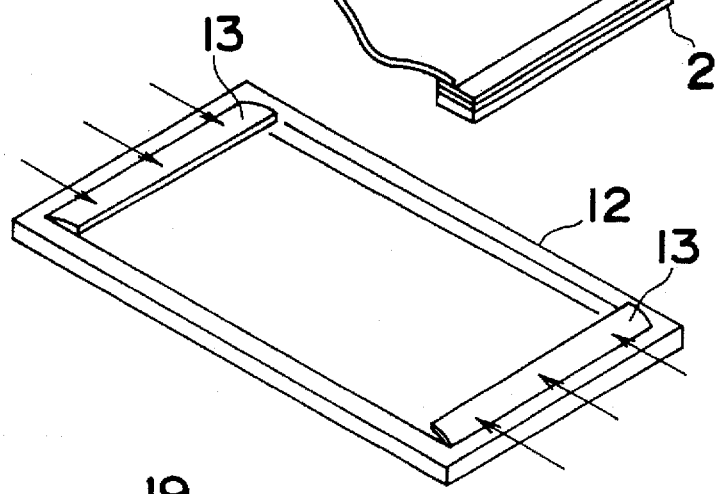
Figure 18:
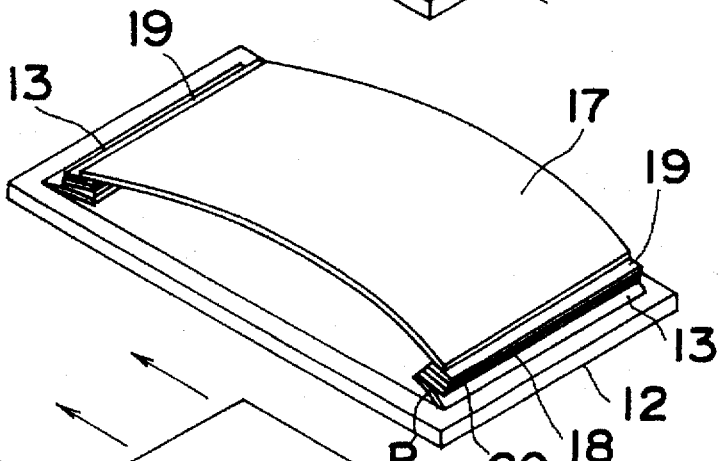
Figure 19:
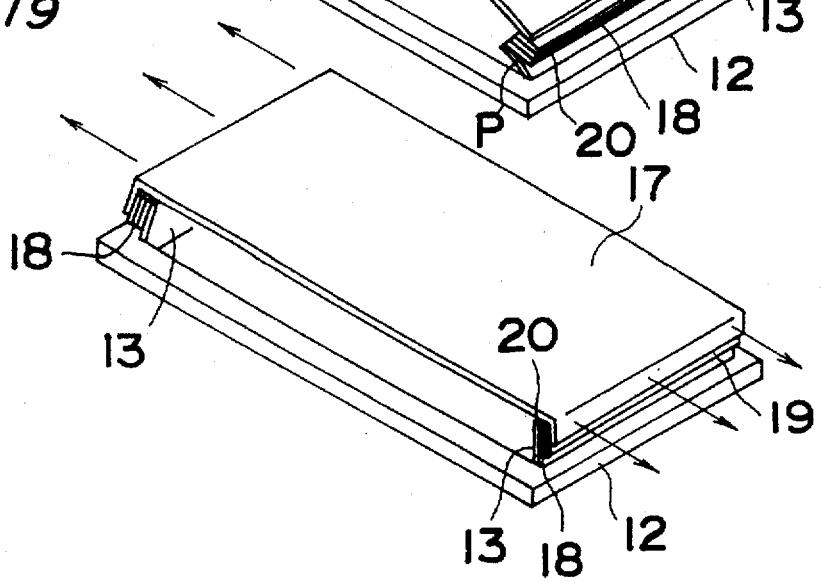

According to a fifth embodiment of the present invention shown in FIG. 16, electrode supporting plates 18 made of ceramic and having an insulating function are attached at both ends of the plate-like electrode 17. The electrode supporting plate 18 has an upper metallic layer 19 and a lower metallic layer 20 metallized at upper and lower ceramic surfaces thereof. The upper metallic layer 19 is welded or soldered at both ends of the plate-like electrode 17. Similar to the embodiment indicated and discussed with reference to FIG. 1, the frame body 12 elastically supporting the plate-like electrode 17 has the leaf springs 13 at two confronting sides thereof as shown in FIG. 17. As shown in FIG. 18, the lower metallic layer 20 at each end of the plate-like electrode 17 is fixedly welded or soldered at a band-like fixing region or fixing points P onto the surface of each leaf spring 13 which is pressed in a direction of arrows in FIG. 17. When the pressing of the leaf springs 13 is released, the plate-like electrode 17 is elastically stretched between the leaf springs 13 as illustrated in FIG. 19. The electrode supporting plate 18 is obtained by spraying a ceramic on to a metallic plate. The upper or lower metallic layer 19 or 20 may be used as a leader terminal.

The plate-like electrode 17 in the fifth embodiment may be formed of 20 μm-thick stainless steel SUS or 100 μm-or-thinner pure iron or "INVAR" (which is the trademark), etc. Further, although the frame body 12 has the leaf springs 13, the leaf springs are not necessary in the case where the frame body is the frame body 16 having elasticity by itself as shown in FIGS. 13–15. The plate-like electrode 17 may consist of a plurality of strips as shown in FIG. 10. If the plate-like electrode 17 is divided into a plurality of strips, the mutual interference is eased, enhancing the flatness 50% or more in comparison with the case where one sheet of the plate-like electrode 17 is used. The width of one strip is favorably not larger than ¼ the width of the sheet of the plate-like electrode 17.

Figure 20:
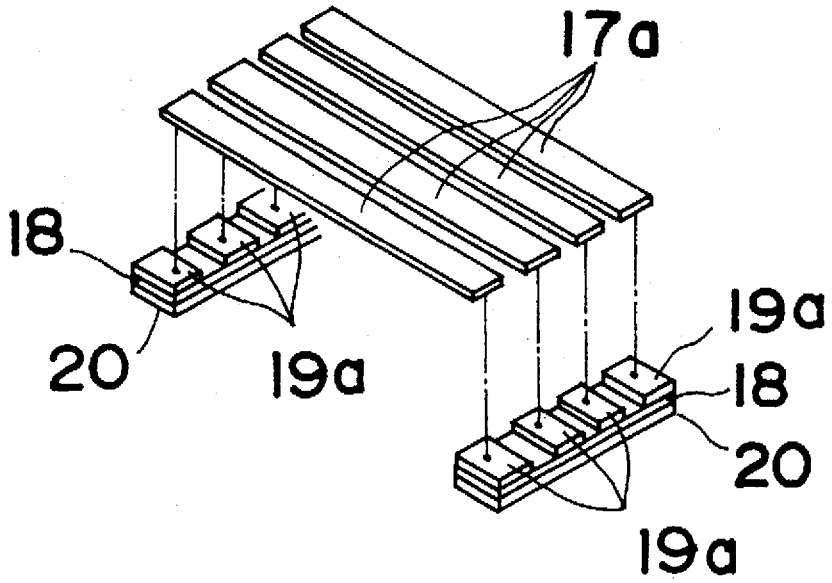
FIGS. 20 and 21 are perspective views indicative of the relationship of a plate-like electrode and an electrode supporting plate in sixth and seventh embodiments of the present invention, respectively.

In a sixth embodiment of the present invention as shown in FIG. 20, the upper metallic layer 19 of the ceramic electrode supporting plate 18 shown in FIG. 16 is divided into four square sections 19*a* in conformity with the width of strip electrodes 17*a*. A potential can be impressed separately to each of a plurality of strip electrodes 17*a* with the constitution of FIG. 20. The upper metallic layer 19 is soldered to or welded to the strip electrodes 17*a*, while the lower metallic layer 20 is soldered to or welded to the frame body 12 or 16.

Figure 21:
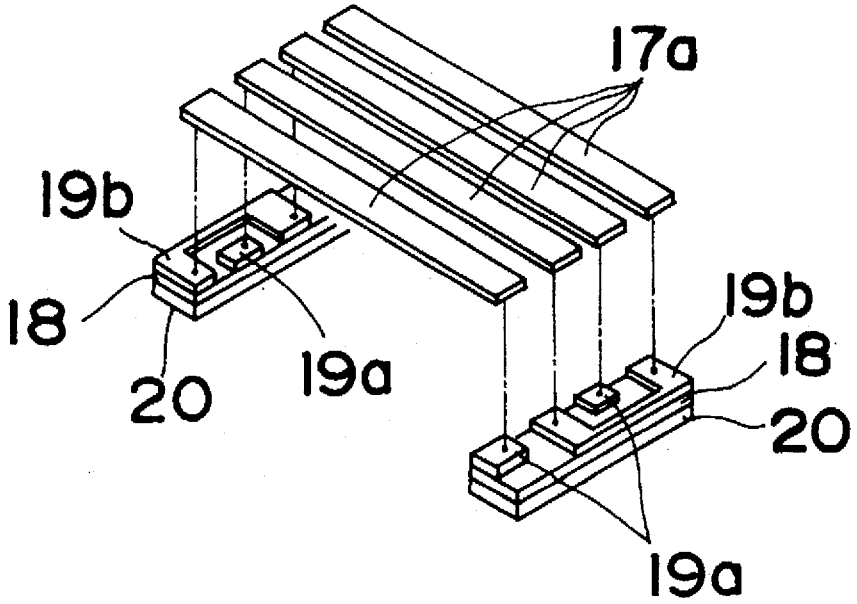

The upper metallic layer 19 is also divided into two square sections 19*a* and one bracket-shaped section 19*b* in a seventh embodiment of FIG. 21. The divided bracket-shaped section 19*b* of the upper metallic layer 19 is so constituted that the square sections to applying a common potential thereto are coupled with each other. Two kinds of potentials are accordingly impressed to the strip electrodes 17*a* via the sections 19*a*, 19*b*, thus reducing the number of leader terminals. The upper metallic layer 19 is obtained, for instance, by metal deposition while the upper surface of the ceramic electrode supporting plate 8 is masked.

Figure 22:
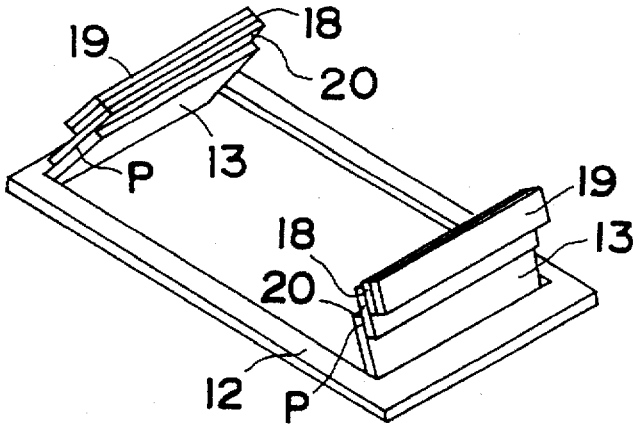
FIGS. 22 and 23 are perspective views showing the coupling state of a frame body and an electrode supporting plate in an eighth embodiment of the present invention.
Figure 23:
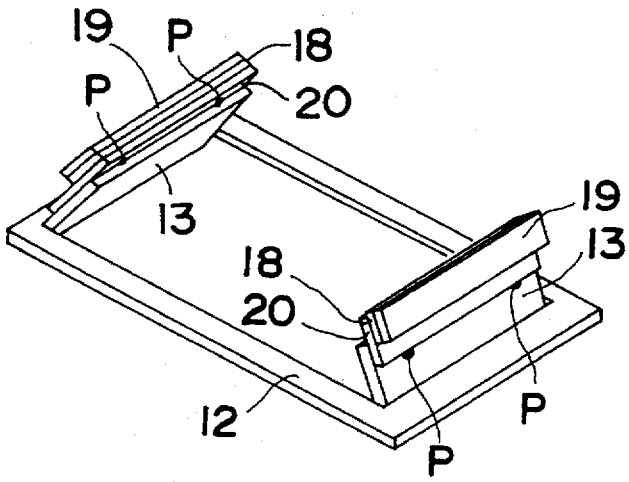

In an eighth embodiment of the present invention of FIG. 22, the leaf spring 13 is rigidly secured to the lower metallic layer 20 at a band-like fixing region P over the length thereof. Meanwhile, according to a modification of the eighth embodiment as shown in FIG. 23, the leaf spring 13 is fixed only at two points in the vicinity of corners of the lower metallic layer 20 as is clear in FIG. 23. The lower metallic layer 20 is larger than the upper metallic layer 19 and the electrode supporting plate 18 and protrudes to the spring 13. An increased bonding area is secured in the former case, so that a larger fixing strength is obtained. The former case is suitable when the spring pressure of the leaf spring 13 or the load is large. On the other hand, the number of bonding points is reduced in the latter case, saving material and simplifying the process. This is suitable for the case where the spring pressure or load is small. Bonding may be carried out face to face or at two or more points of each side.

Figure 24:
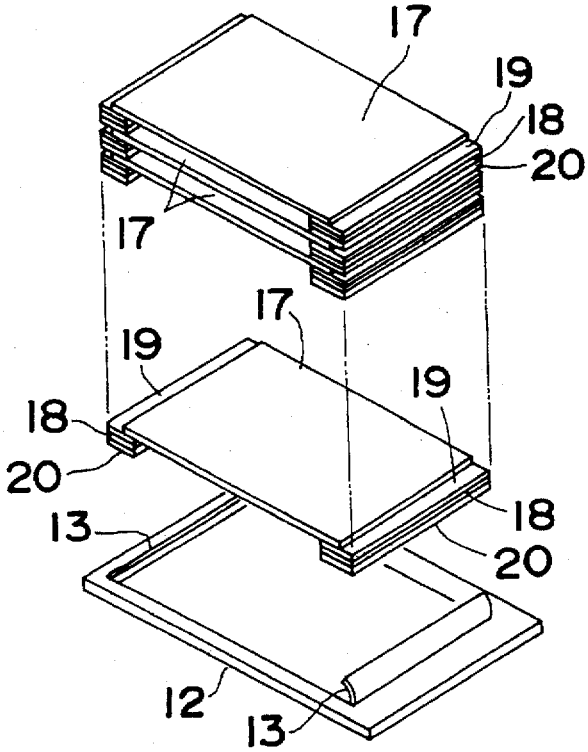
FIG. 24 is a perspective view of the relationship between a plate-like electrode and a frame body in a ninth embodiment of the present invention.

Although a plurality of frame bodies 12 or 16 are layered in a manner as in FIGS. 11 and 12 after the plate-like electrodes 17 (or strip electrodes 17*a*) are elastically supported thereon, it may be possible to employ a method of FIG. 24 as a ninth embodiment of the present invention. In FIG. 24, integral bodies each consisting of the plate-like electrode 17 bonded to the electrode supporting plate 18 via the upper metallic layer 19 are layered in a plurality of stages. Both ends of the thus-layered unit are tightly bonded to a pair of leaf springs 13 of the bent frame body 12. The ninth embodiment ensures higher accuracy to regulate the mutual distance of the layered plate-like electrodes 17 (or strip electrodes 17*a*).

Figure 25:
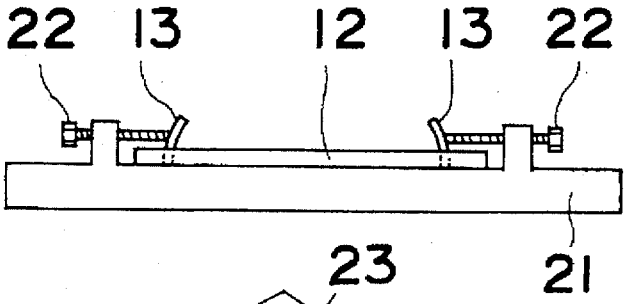
FIGS. 25, 26, and 27 are side views of a process wherein a frame body or a leaf spring of the frame body is bent.

In a process for bending the springs 13 in FIG. 25, the leaf springs 13 of the frame body 12 set on a stage 21 are bent in directions to be brought close to each other when bolts 22 are screwed.

Figure 26:
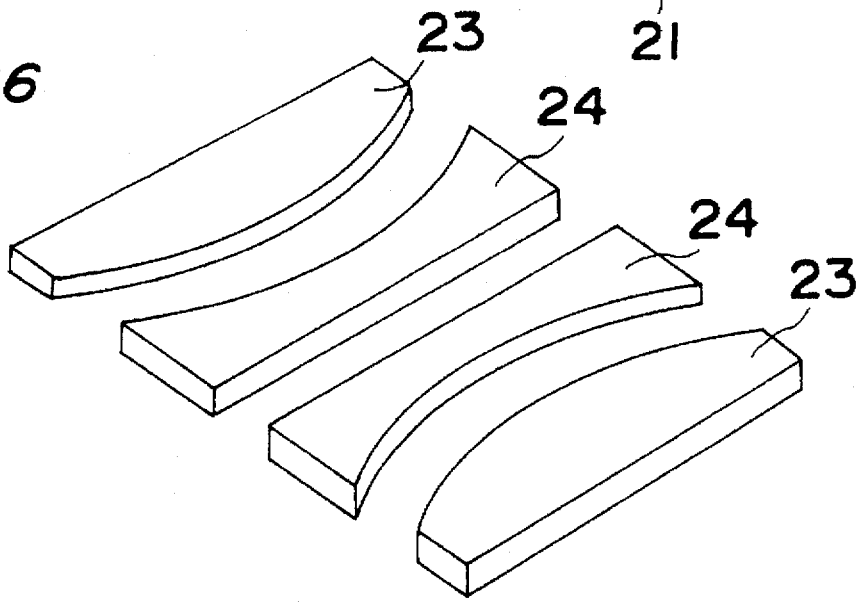
Figure 27:
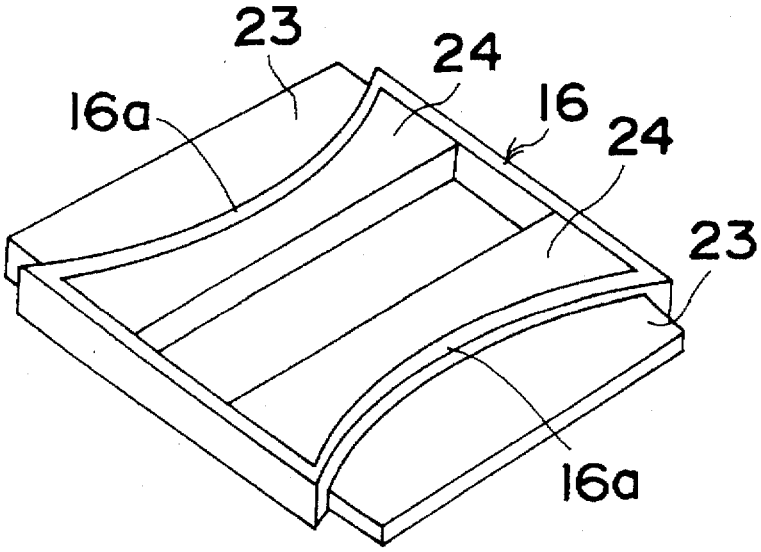

In the meantime, as shown in FIGS. 26 and 27, the frame body 16 is held and bent between a pair of projecting press dies 23 and a pair of concave press dies 24.

According to the present invention, since each plate-like electrode is elastically stretched between two confronting sides of the frame body, the flatness of the plate-like electrode and the mutual distance of the plate-like electrodes are regulated with high accuracy. Moreover, it is not necessary to dispose glass insulating layers at the central part of each plate-like electrode, and the fixing points and the fixing region are reduced, whereby the manufacturing costs are decreased, whereas thermal and mechanical strains are generated less. Furthermore, the supporting strength of the plate-like electrodes is increased and the vibration resistance is improved.

In the present invention, both ends of the plate-like electrode are securely fixed to the two opposite sides of the frame body supporting the plate-like electrode or to the leaf springs in a state where the two sides or leaf springs are pressed to reduce the mutual distance therebetween. Therefore, when the pressing is released, the tensile force acts on the plate-like electrode in two directions, hence supporting the plate-like electrode elastically with a high degree of flatness and without warp. Further, since it is not required to arrange glass insulators at the central part of the plate-like electrode, the plate-like electrode is prevented from being deformed or the mutual distance of the electrodes does not become irregular.

A tenth embodiment of the present invention will be described with reference to the corresponding FIGS. 28–36 wherein the plate-like electrode 17 is stretched to connect to the frame body 16 differently from the first through ninth embodiments.

Figure 28:
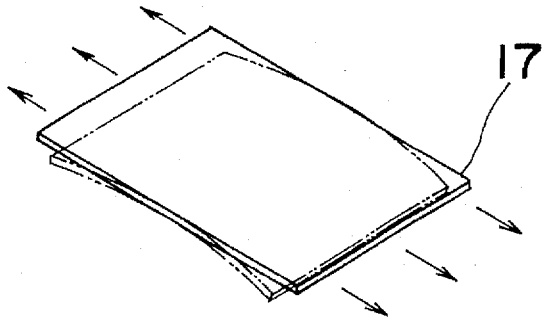
FIGS. 28, 29, 30, and 31 are perspective views of an assembling process of a plate-like electrode and a frame body in a tenth embodiment of the present invention.
Figure 29:
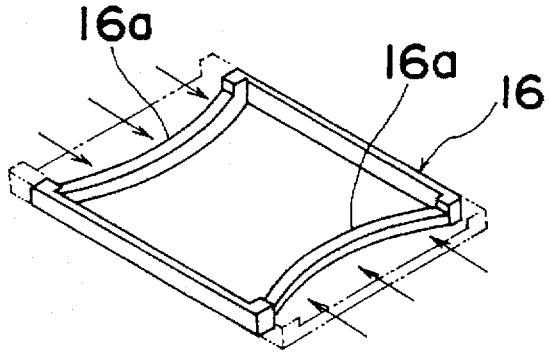

Both ends of the plate-like electrode 17 are pulled outward in the opposite directions as shown in FIG. 28. As a result, for example, 10 Kgf/mm$^2$ tensile force is generated uniformly all over the surface of the plate-like electrode 17. On the other hand, two confronting and recessed step portions 16*a* of the frame body 16 each having an elasticity function are pushed inward with e.g. 10 Kg/mm$^2$ in directions designated by arrows in FIG. 29. Consequently a load of uniform distribution is impressed to the frame body 16 to thereby produce resilience.

Figure 30:
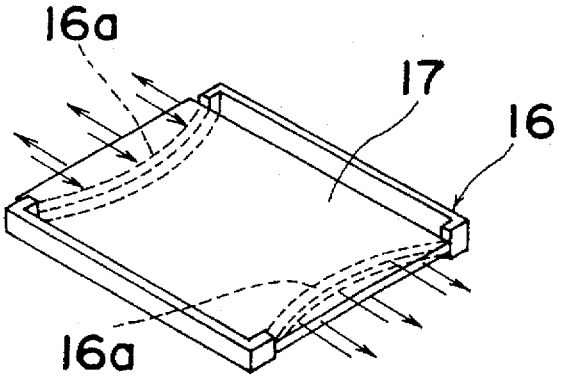

While the pulling and pushing states as above are maintained, the plate-like electrode 17 is overlapped on the frame body 16 as shown in FIG. 30 and both ends of the plate-like electrode 17 are secured to the two sides 16*a* of the frame body 16. In the tenth embodiment, the two sides 16*a* of the frame body 16 are wholly welded or soldered face to face to the plate-like electrode 17.

Figure 31:
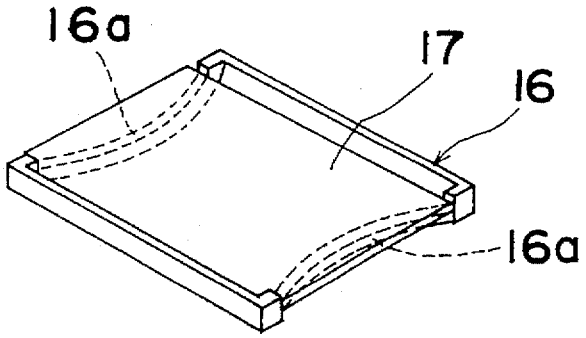

The pulling and pushing states are loosened at the completion of the welding or soldering. Since the contractile force on the plate-like electrode 17 balance with the resilient force of the frame body 16 at this time, the plate-like electrode 17 is stretched over the frame body 16 with a high degree of flatness, as shown in FIG. 31.

Figure 32:
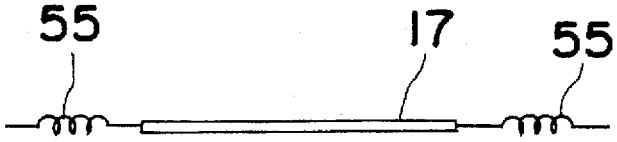
FIG. 32 is a schematic diagram of a stretching process of a plate-like electrode in the tenth embodiment of the present invention.

Springs 55 of FIG. 32 are used in the pulling process of the plate-like electrode 17. In this case, the spring 55 should have a spring force equivalent to 10 Kgf/mm$^2$.

Figure 33:
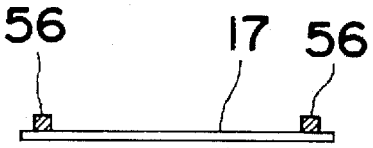
FIGS. 33 and 34 are schematic diagrams of another stretching process of a plate-like electrode in the tenth embodiment of the present invention.
Figure 34:
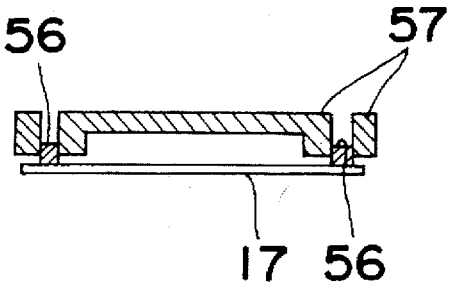

In another example of the pulling process as shown in FIG. 33, brackets 56 are provided at both ends of the plate-like electrode 17. In FIG. 34, similar to the case of press molding, brackets 56 are depressed by a die 57 thereby to impress an amount of forced shift calculated from a predetermined tensile force to the plate-like electrode 17.

Figure 35:
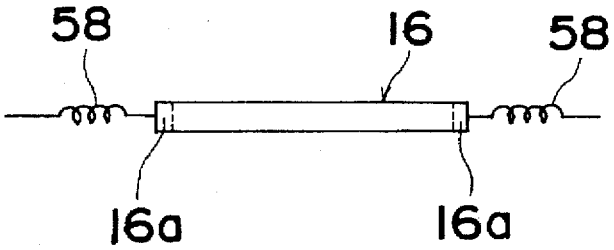
FIG. 35 is a schematic diagram of a pressing process of a frame body in the tenth embodiment of the present invention.
Figure 36:
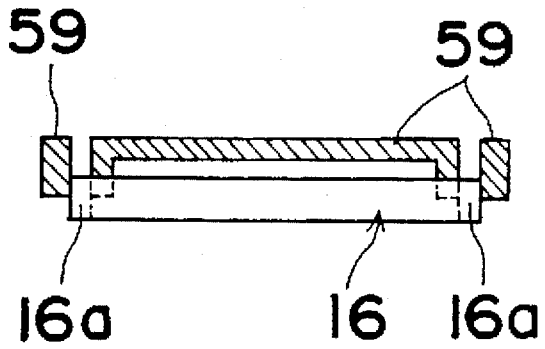
FIG. 36 is a schematic diagram of another pressing process of a frame body in the tenth embodiment of the present invention.

In the pushing process, springs 58 represented in FIG. 35 are employable to press two step portions 16*a* of the frame body 16. The springs 58 press the two step portions 16*a* inward with 10 Kgf/mm$^2$ spring force. In FIG. 36, two step portions 16*a* of the frame body 16 are pressed inward by a die 59 to add an amount of forced shift to the frame body 16. For example, the die 59 is formed of the projecting press dies 23 and the concave press dies 24 of FIGS. 26, 27 which are integrally moved inwardly to press the step portions 16*a*.

Figure 37:
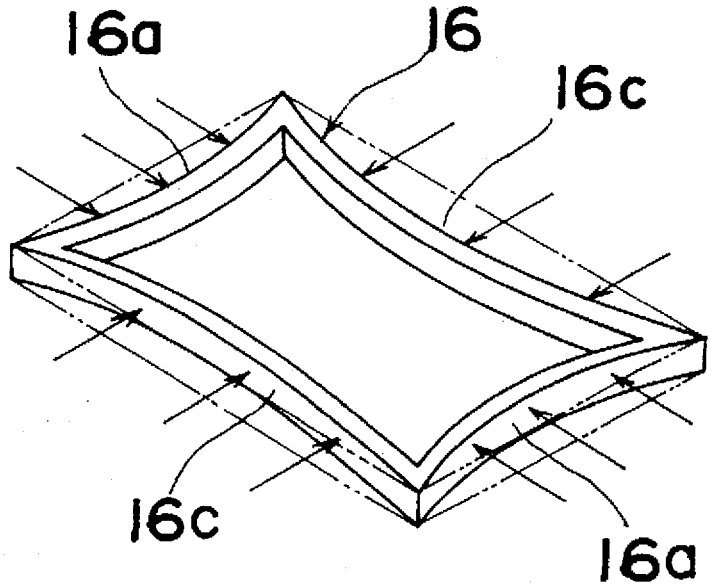
FIG. 37 is a perspective view of a pressing process of a frame body in an eleventh embodiment of the present invention.

In an eleventh embodiment of the present invention of FIG. 37, not only are the two step portions 16*a* intersecting a horizontal axis of the frame body 16 in FIG. 36 are pressed inward, but the remaining two sides 16*c* of the frame body 16 are likewise pressed inward. The plate-like electrode 17 with the tensile force added thereto is overlapped with the frame body 16 bent in the above pressing process, so that the plate-like electrode 17 and the frame body 16 are mutually secured at four sides 16*a*, 16*a*, 16*c*, 16*c*. Thereafter, the external force, i.e., the pushing and pulling forces, are released. The plate-like electrode 17 can be stretched over the frame body 16 with a much higher degree of flatness in accordance with the method of FIG. 37.

Although the above external force is different depending on the material, thickness, strength, or the like of the frame body 16, a practically useful value is 8–12 Kgf/mm$^2$. For example, in a 14 inch-flat display device, when a plate-like electrode of 260 mm×200 mm with a thickness of 0.020 mm is pulled by 10 Kgf/mm$^2$, a force for pulling one electrode in its longitudinal direction is found by an expression: 200 mm×0.020 mm×10 Kgf/mm$^2$=40 kg, and a force for pulling it in a direction perpendicular to the longitudinal direction is found by an expression: 260 mm×0.020 mm×10 Kgf/mm$^2$= 52 Kg. The original aim is not satisfied unless the tensile force balances with the pressing force. According to a twelfth embodiment of the present invention, an amount of forced shift corresponding to the tensile force (e.g., 10 Kgf/mm$^2$) required for the plate-like electrode 17 to maintain a predetermined flatness may be added to the frame body 16 instead of the plate-like electrode 17.

Figure 38:
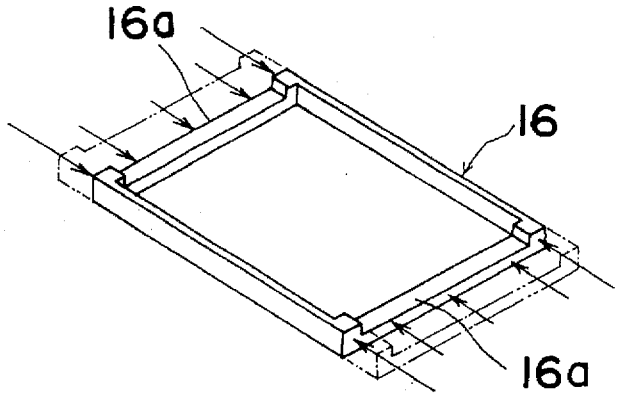
FIGS. 38, 39, 40, and 41 are perspective views of an assembling process of a plate-like electrode and a frame body in a twelfth embodiment of the present invention.

When the step portions 16*a* of the frame body 16 are pressed with a force equivalent to the amount of forced shift as indicated in FIG. 38, it is executed in a manner to represent a curved distribution wherein the pressing force is at a minimum at the center of the interval of the two step portions 16*a*. Subsequently, the step portions 16*a* are further pressed inward with e.g. 10 Kgf/mm$^2$ as shown in FIG. 39, so that a strong resilience is generated in the frame body 16.

Figure 40:
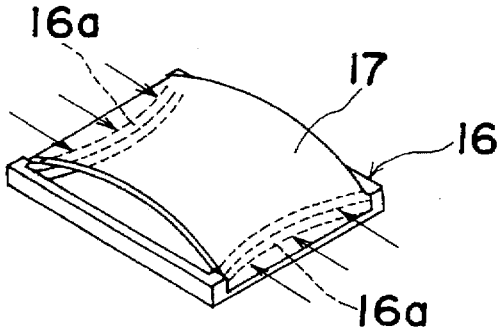
Figure 41:
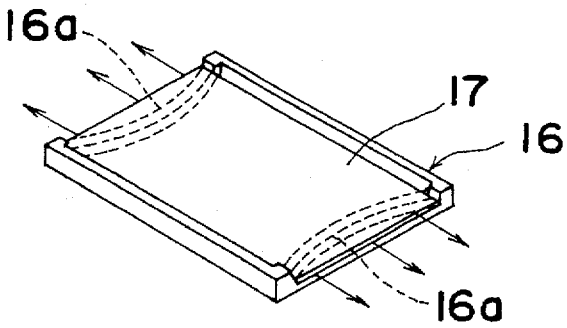

Both ends of the plate-like electrode 17 are fixedly secured by welding or soldering to the opposite step portions 16*a* of the frame body 16 in the above state as shown in FIG. 40. No tension is impressed to the plate-like electrode 17 in this stage of fixing. Although the plate-like electrode 17 greatly warps in the exaggerated illustration in FIG. 40, the electrode 17 actually warps only slightly. Thereafter, the pressing on the frame body 16 is freed, whereby, as shown in FIG. 41, the plate-like electrode 17 is supported between the two step portions 16*a* of the frame body 16 while the high degree of flatness is maintained.

Figure 39:
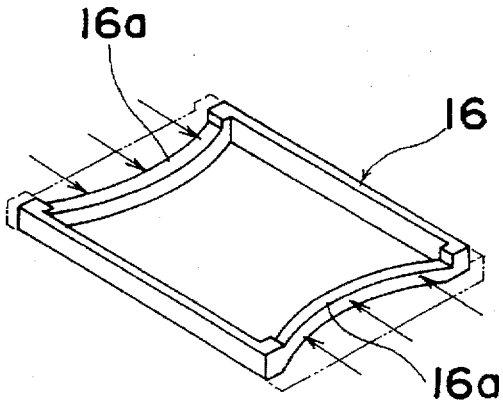

In the twelfth embodiment, the pressing in FIG. 38 may be concurrently performed with that in FIG. 39.

In any case of this embodiment, pulling of the plate-like electrode 17 is exerted by the action of the frame body 16. Therefore, the same operation and effect as achieved in the tenth embodiment can be realized without preliminarily stretching the plate-like electrode 17, thus reducing the number of tools and processes.

Figure 42:
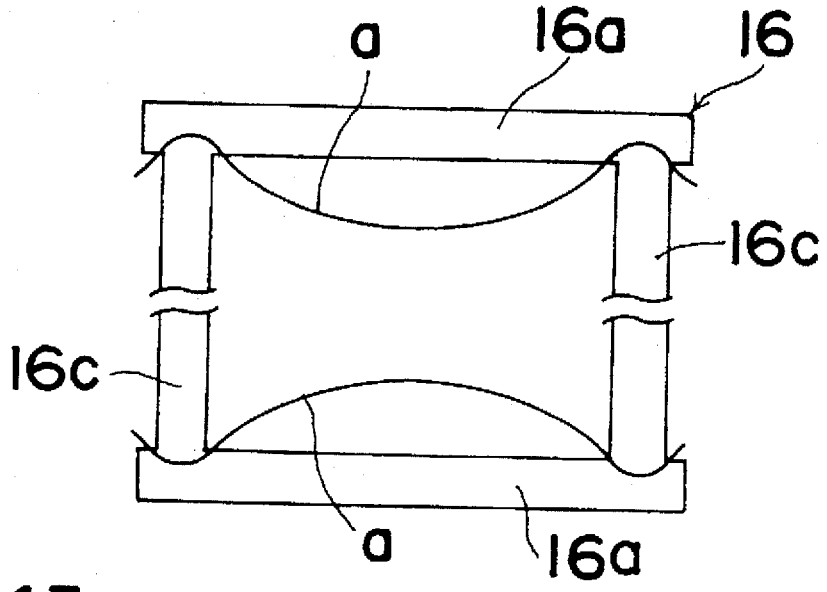
FIGS. 42 and 43 are diagrams indicating the relationship of the amount of forced shift of a frame body and the residual resilience of the frame body.
Figure 43:
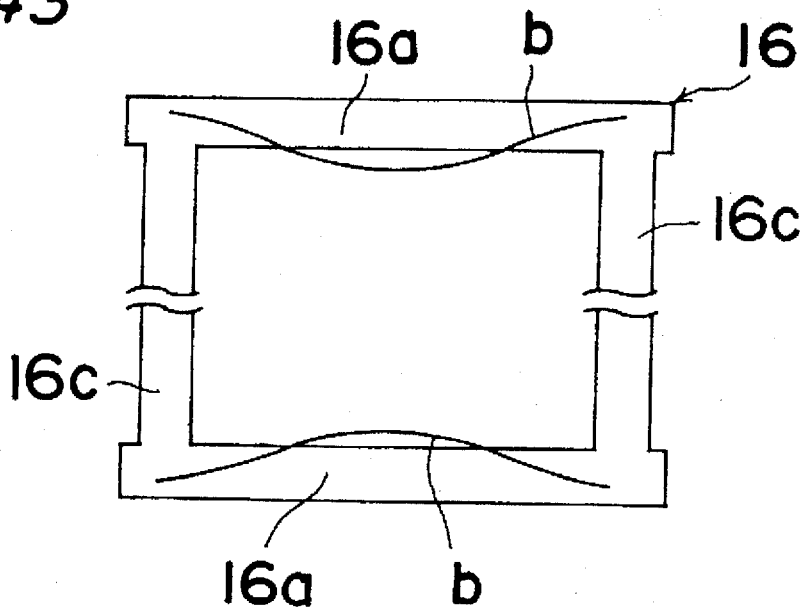
Figure 44:
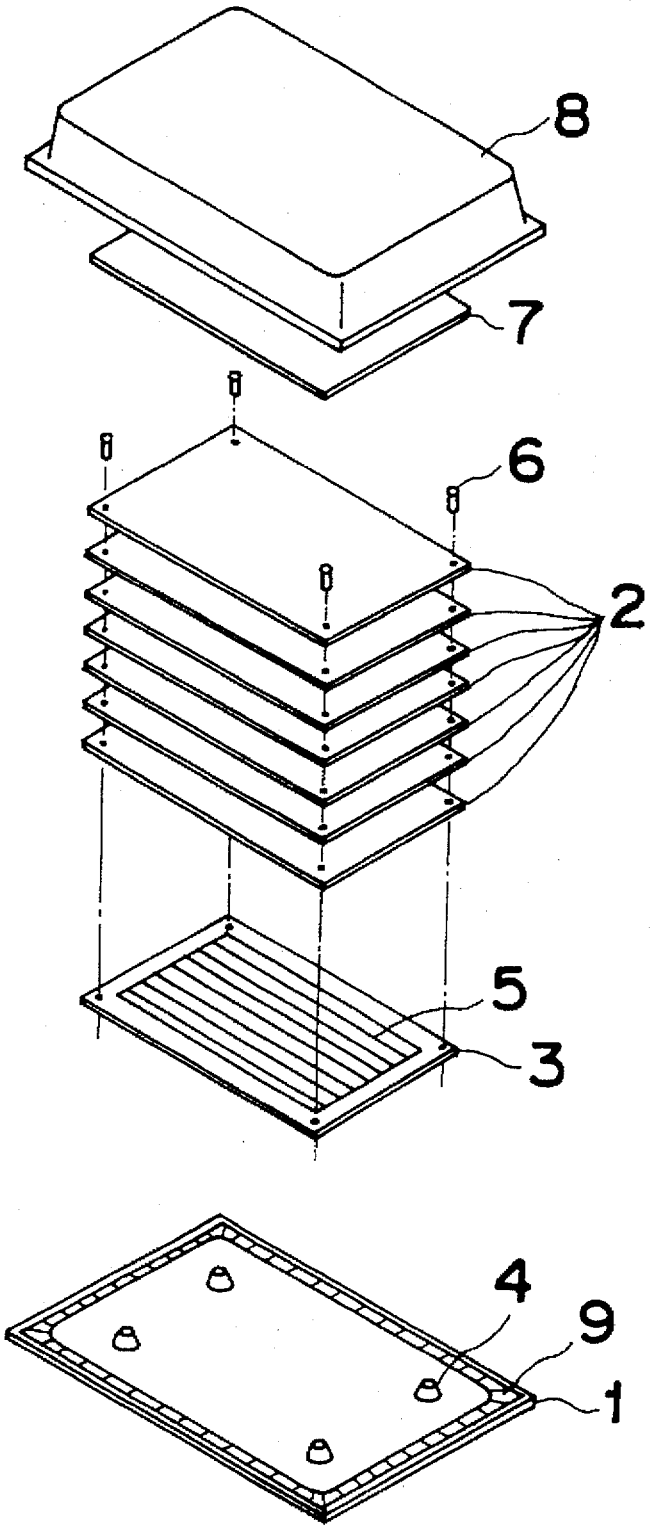
Fig. 44 PRIOR ART
FIG. 44 is an exploded perspective view of a conventional flat display device.
Figure 45:
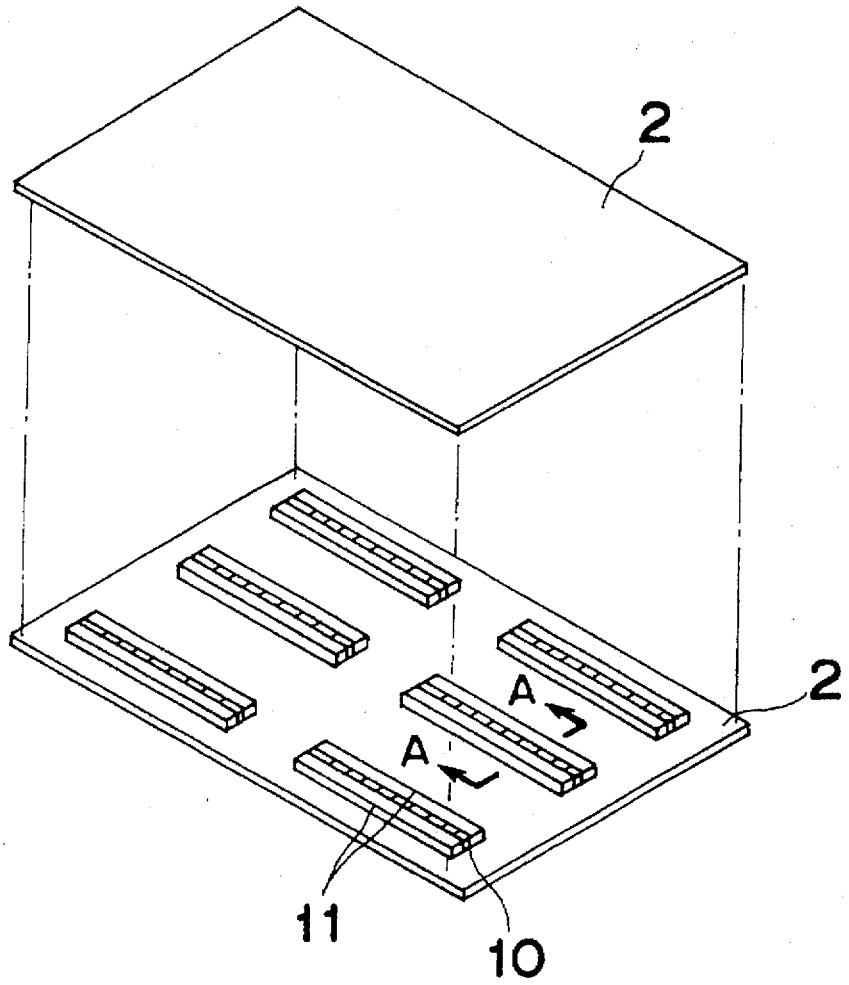
Fig. 45 PRIOR ART
FIGS. 45 and 46 are a diagram explanatory of a conventional forming method of insulating layers between electrodes in a conventional flat display device and a sectional view taken on line A—A in FIG. 45.
Figure 46:
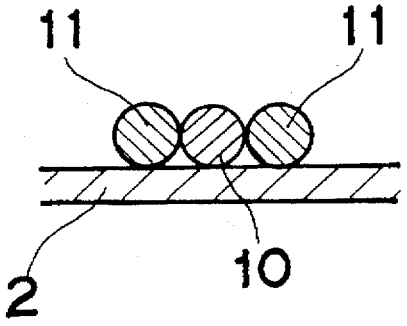
Fig. 46 PRIOR ART

The frame body 16 in FIG. 42 has two step portions 16*a* each having a 360 mm width. The distribution of the amount of forced shift represents a curve (a) showing the minimum value at the center of the interval of the step portions 16*a*. Meanwhile, the distribution of the resilient force remaining in the step portions 16*a* of the frame body 16 with the external pressure removed therefrom after secured to both ends of the plate-like electrode 17 is a curve (b) in FIG. 43.

According to the present invention, since the plate-like electrode can be stably stretched with uniform distribution between two opposite step portions of the frame body, it becomes possible to regulate the flatness of the plate-like electrode and the distance of electrodes with high accuracy.

The tensile force in uniform distribution is generated at the surface of the plate-like electrode when both ends of the plate-like electrode are pulled in two opposite directions. In the meantime, two confronting sides of the frame body are pressed inward with the force of the distribution approximately corresponding to that of the above tensile force. Both ends of the plate-like electrode are fixed to the two sides of the frame body in the above state. Since the two sides of the frame body are pressed so as to show a curved distribution wherein the minimum value appears in the middle of the interval of the two sides and the two sides impress the spring force of uniform distribution to the plate-like electrode, the contractile force of the plate-like electrode resulting when both the tensile force and the pressing force are released balances with the resilience of the frame body. In other words, the state nearly coincident to that before the forces are released is maintained, and accordingly the plate-like electrode receiving the uniform tensile force is stably stretched over the frame body with a high degree of flatness.

According to a further feature of the present invention, when both sides of the plate-like electrode are secured to the two sides of the frame body by pressing the two sides inward, the pressing force to each side is of such a distribution as to deform the frame body to add the uniform tension to the plate-like electrode when the pressing is freed. Therefore, it becomes unnecessary to pull the plate-like electrode beforehand. That is, the pulling action to add the tension to the plate-like electrode is carried out by the frame body. The contractile force of the plate-like electrode is balanced with the resilience of the frame body in a relatively smaller number of processes.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A manufacturing method of a flat display device, which comprises the steps of:

pressing a pair of leaf springs provided respectively at two confronting sides of a frame body thereby to bend the frame body in directions such that the confronting sides become closer to each other;

securely fixing both ends of a plate-like electrode to the pair of bent leaf springs; and releasing the pressing of the leaf springs to thereby restore the leaf springs.

2. A manufacturing method of a flat display device, which comprises the steps of:

pressing two confronting sides of an elastic frame body inward to thereby bend the frame body and reduce an interval between the two confronting sides;

securely fixing both ends of a plate-like electrode to the two confronting sides of the reduced interval; and releasing the pressing to thereby restore the two confronting sides of the frame body.

3. A manufacturing method of a flat display device which comprises the steps of:

pressing two confronting sides of an elastic frame body inward to thereby bend the frame body and reduce an interval between the two confronting sides thereof;

layering and securely fixing both ends of a plate-like electrode to the two confronting sides of the frame body with the reduced interval via a ceramic layer; and releasing the pressing to thereby restore the two confronting sides of the frame body.

4. A supporting method of a plate-like electrode of a flat display device which comprises the steps of:

pulling both ends of the plate-like electrode in two opposite directions parallel to a surface of the plate-like electrode, thereby generating a tensile force of uniform distribution on the plate-like electrode;

pressing and bending two confronting sides of an elastic frame body inward with a force distributed to approximately balance with the tensile force in each direction;

securely fixing both the ends of the plate-like electrode where the tensile force is exerted to the two confronting sides of the bent frame body; and releasing the tensile force and the pressing force.

5. The supporting method according to claim 4, wherein the two confronting sides to be pressed are one of opposite ends of the elastic frame body in a longitudinal direction of the elastic frame body and opposite ends of the elastic frame body in a direction that crosses the longitudinal direction of the elastic frame body.

6. The supporting method according to claim 4, wherein the plate-like electrode comprises a plurality of electrodes layered with a predetermined insulating distance kept therebetween.

7. A supporting method of a plate-like electrode of a flat display device which comprises the steps of:

pressing two confronting sides of an elastic frame body inward to thereby bend the frame body;

securely fixing both ends of the plate-like electrode to the two confronting sides of the bent frame body; and releasing the pressing, whereby the pressing is conducted with a pressing force of distributed such that the force deforms the frame body so as to provide a uniform tension to the plate-like electrode when the pressing is released.

* * * * *